US005533659A

United States Patent [19]

Meyer

[11] Patent Number: 5,533,659

[45] Date of Patent: Jul. 9, 1996

[54] DUST REMOVAL SYSTEM

[75] Inventor: Walter G. Meyer, Boll, Germany

[73] Assignee: Beloit Technologies, Inc., Wilmington, Del.

[21] Appl. No.: 190,172

[22] PCT Filed: Sep. 9, 1992

[86] PCT No.: PCT/US92/07583

§ 371 Date: Feb. 1, 1994

§ 102(e) Date: Feb. 1, 1994

[87] PCT Pub. No.: WO93/06035

PCT Pub. Date: Apr. 1, 1993

[30] Foreign Application Priority Data

Sep. 14, 1992 [DE] Germany ..... 9111448 U

[51] Int. Cl.[6] ..... B65H 20/00

[52] U.S. Cl. ..... 226/189; 226/97

[58] Field of Search ..... 226/97, 7, 189, 226/168, 196; 83/100, 168, 24

[56] References Cited

U.S. PATENT DOCUMENTS

| | | | |
|---|---|---|---|
| 1,595,475 | 8/1926 | Minton | 226/97 X |
| 3,406,924 | 10/1968 | Bruns et al. . | |
| 4,300,421 | 11/1981 | Yano et al. | 83/100 X |
| 4,484,500 | 11/1984 | Reba et al. | 83/98 |
| 4,704,930 | 11/1987 | Bodewein | 83/100 X |
| 5,036,737 | 8/1991 | Glaser | 83/100 |
| 5,062,334 | 11/1991 | Killilea et al. | 83/99 |
| 5,072,638 | 12/1991 | Hüser | 83/24 |

FOREIGN PATENT DOCUMENTS

| | | |
|---|---|---|
| 0364392A2 | 4/1990 | European Pat. Off. . |
| 0431275 | 6/1991 | European Pat. Off. . |

*Primary Examiner*—John P. Darling

*Attorney, Agent, or Firm*—Dirk J. Veneman; Raymond W. Campbell; Gerald A. Mathews

[57] ABSTRACT

Apparatus for spreading a plurality of co-traveling web portions of a cut web such that a defined spacing is produced and maintained between the web portions. The apparatus includes a pair of spaced, perforated plates for permitting the application of sub-atmospheric air pressure to both sides of the traveling web portions to remove particulate matter from both surfaces of the web portions. The web spreading and particulate matter removing apparatus are connected to move as a unit while maintaining the spacing of the perforated plates from the web.

8 Claims, 1 Drawing Sheet

DUST REMOVAL SYSTEM

BACKGROUND OF THE INVENTION

1. Field of the Invention

The invention concerns a width adjusting machine for reel cutters with at least two web guide rollers. More particularly, this invention relates to a compact apparatus for spreading a traveling fibrous web, such as a sheet of paper, which has been cut in the direction of web travel, such that the cut web portions are spread laterally of their direction of travel, and for collecting and discharging the dust particles produced while maintaining a predetermined gap distance between the cut web portions.

2. Description of the Prior Art

Reel cutters separate a material web that is unwound from a roller, having an elongated axial portion in the longitudinal direction (web advance direction) into several partial (i.e. narrower slit web portions) webs which are subsequently wound up again. During this process, it is very important to guide the partial webs exactly parallel to each other and to avoid mutual defects on the cut edges of adjacent partial webs. Width adjusting machines with two web guide rollers are increasingly utilized for this purpose, whereby the first roller, viewed in the web advance direction, has a spherical shape (i.e. profile) in the area of the partial, or circumferentially extending, surface on either side of which the material web is wound, which shape is preferably obtained by a corresponding bending of the axis of this web guide roller. This first web guide roller expands the entire web material widthwise, whereby adjacent partial webs diverge in the area of the cut edges, so that they are no longer parallel. In order to provide a possibility for an exact subsequent winding of the partial webs, however, these webs must be guided parallel to each other. A second web guide roller which becomes effective within a certain distance from the first web guide roller, preferably, a few hundred ram, and whose partial surface around which the web material is wound is constructed with its surface profile opposite to the spherical or convex shape of the first web guide roller, that is, in a concave shape. The individual partial webs, which by now have a certain lateral distance between each other, are guided back in a parallel direction while maintaining their separation. Such a width adjusting machine thus has a substantial space requirement between the cutting station and the winding station of the reel cutting machine.

Above and beyond these requirements, reel cutters usually necessitate the removal of dust and/or possible residue produced during the longitudinal cutting, or slitting, process and deposited on the material web. These generally known dust removal systems thus also have a substantial space requirement which, as mentioned above, even further exacerbates the problems of all-too-confined space conditions.

SUMMARY OF THE INVENTION

Starting from these facts, the invention is based on the objective to arrange a dust removal system as well as a dual expander roller arrangement in a reel cutting machine within the confined space between the cutting station and the winding station. It is further desired to create the insertion of the partial webs into the machine components arranged after the cutting station in as uncomplicated a manner as possible.

The aforementioned objective is attained by a width adjusting machine for reel cutters that is constructed by passing the traveling web successively over a convexly bowed web-spreading roller and concavely bowed roller to maintain the slit web portions spaced apart. Intermediate these first and second rollers is a dust collector which comprises a pair of spaced vacuum plates which are positioned on either side of the web. The essentially plane plates with suction openings utilized according to the invention can, with the concept of the invention, be realized by different means, similar to the shape and arrangement of the suction openings; however, it must be ensured that a sufficiently strong and evenly distributed suction air flow can be realized with simultaneously sufficient mechanical stability, such that the unwanted impurities deposited on the traveling web will be removed and discharged through the suction openings. The plates can be provided with slots, bores or similar structures for this purpose, or they can consist of an intersecting or non-intersecting screen structure with screening spaces.

The invention has the advantage of providing high efficiency with regard to the dust removal with the smallest structural dimensions, and, furthermore, it simplifies the insertion process of the web ends.

The production of the suction air flow and its discharge, including the discharge of the removed particles, can be realized by most different means, for example, by flexible or rigid pipes that exit at the suction openings. Particularly preferred is a construction where the plate with the suction openings is part of one hollow body that extends over the width of the material web (machine width). This arrangement is not only uncomplicated with regard to structural considerations, but it can also be constructed very effectively with regard to the flow technology. Such an arrangement has a particularly small space requirement and is particularly effective with regard to mechanical considerations if both hollow bodies are part of a support arrangement for the web guide rollers of the width adjusting apparatus arranged to both sides of the plate since this manner of construction makes it possible to omit the otherwise necessary torsion rods or similar structural elements arranged lateral to the material web. In this particular instance, both hollow bodies are provided with the plates which are preferably rigidly connected at their front ends with one bracket for each of the two web guide rollers that are arranged to both sides of the plates, whereby both hollow bodies and both brackets together form the support arrangement. This makes it possible to install or remove the width adjusting machine, together with the suction device, from the reel cutting machine as a compact, in particular, prefabricated, possibly even modular, structural unit (group of structural components), or it can, if so desired, be subsequently installed in the most simple manner. The structure of the support arrangement designated as "brackets" can be realized by most different means, whereby the most important factor is not a narrowly defined bracket-like structure, but structural elements, or a structural group comprised of several structural elements provided on each of the front ends, can serve as a receptacle for the bearings of the web guide rollers and can also be rigidly connected with the hollow bodies extending over the width of the machine.

The arrangement according to the invention is particularly advantageous when the support arrangement of both web guide rollers is swiveled about an axis that extends parallel to the rotational axis of the guide rollers. In this particular instance, the dust removal plates also swivel without altering the web advance geometry in the area of the gap formed between the two plates. This generally known ability to swing horizontally of both web guide rollers of the width adjusting machine alters the winding angle of the material web around the web guide rollers and thus leads to an alteration of their efficiency. Such alterations are, for example, required during a change of the number and/or the width of the partial webs of the material web.

Practical examples of the object of the invention, which in particular ensure good guidance and insertability of the partial webs, are recited in, and are apparent from, the claims.

The aforementioned structural components to be utilized according to the invention, as well as the ones claimed and described in the examples, are not subject to any particular exceptions with regard to their size, shape, material selection and technical concept, so that the selective criteria known in the corresponding application area can be applied without limitations.

Further details, characteristics and advantages of the object of the invention result from the following description of the preferred embodiment in conjunction with the corresponding drawing which shows a preferred example of a width adjusting machine according to the invention. The drawing shows a schematic representation of the width adjusting machine according to the invention in a sectional view in which the cutting plane lies parallel to the web advance direction and perpendicular to the web guide rollers.

The width adjusting machine with dust removal system according to the invention can basically also be advantageously applied with material webs that are not or not yet divided in the longitudinal direction. It is basically possible to separate most different web materials in accordance with the object of the invention, with the object of the invention, in particular, paper and cardboard materials, but also fibrous materials or foils consisting of metal, plastic or similar materials, or even multi-layered materials.

DESCRIPTION OF THE PREFERRED EMBODIMENT

Figure 1:
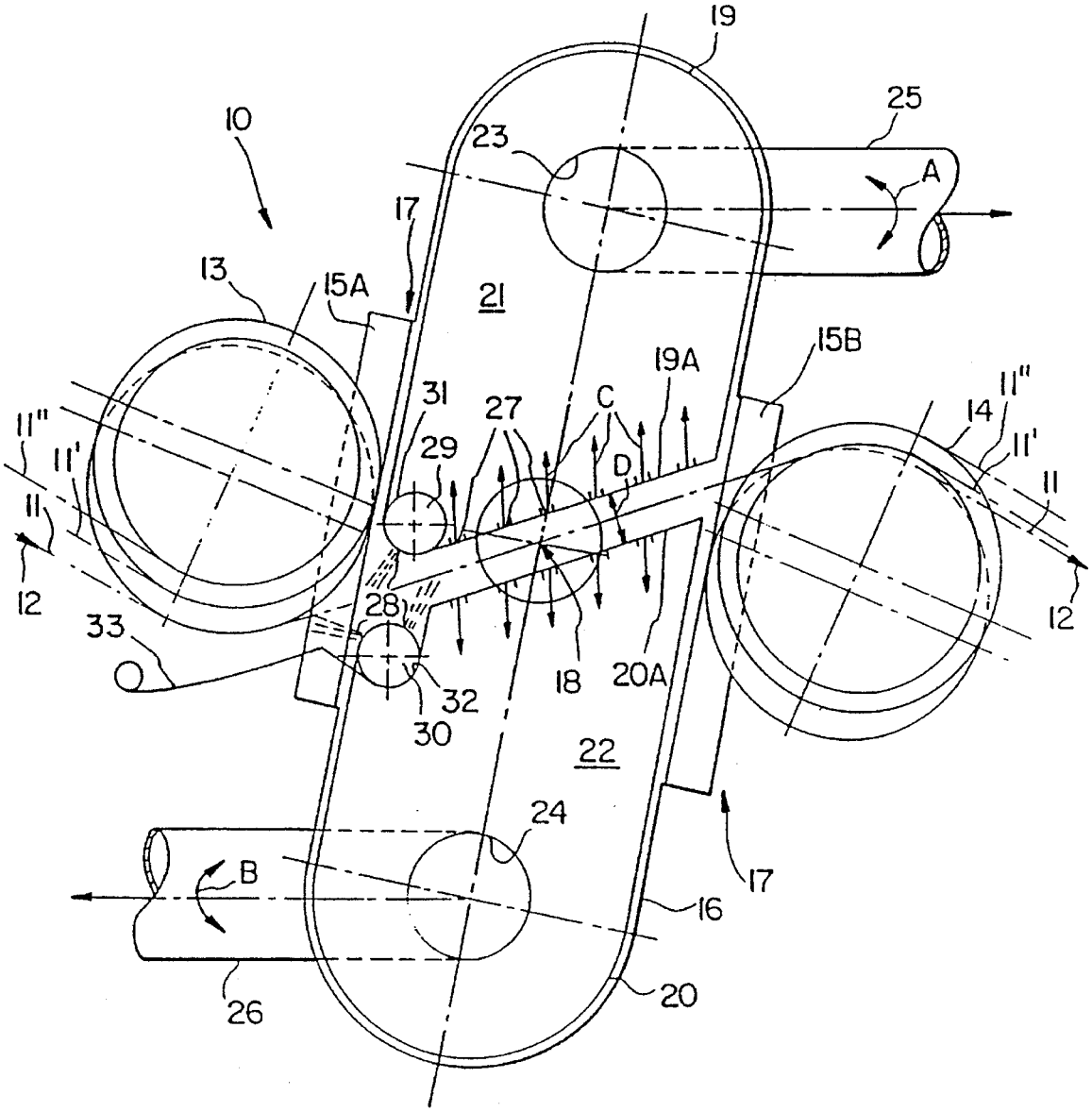
FIG. 1 is a side-elevational view of this invention, in somewhat schematic form, showing the bowed first and second web guide rollers rotatably mounted on either side of the dust collecting apparatus.

In the FIGURE, the path of the material web 11 which takes the form of a plurality of longitudinally slit partial webs 11,11',11" in a practical embodiment, through a width adjusting machine 10 is illustrated by the broken lines (long and short dashes), and the web advance direction is indicated by the arrows 12. Viewed in the web advance direction, the material web 11 is at first wound around a first web guide roller 13 by a small angle of approximately 40° and subsequently in reverse winding direction around a second web guide roller 14, whereby a linear web portion with a length of a few decimeter, for example, 5 decimeter, is located between the two web guide rollers. The surface profile of the part of the web guide roller 13 around which the material web 11 is wound is convex, when viewed in the direction of web travel, while the corresponding portion of the web guide roller 14 surface profile is shaped in a concave manner. In the preferred example shown in the FIGURES, this shape is obtained by a corresponding bending of both web guide rollers (see, for example, DE AS 22 01 844).

Pillow blocks 15A or 15B for support of the web guide rollers 13 and 14 are provided on the corresponding front ends of the web guide rollers 13 and 14. These pillow blocks are, in turn, connected, in particular, screwed, to the retaining plate 16, so that the pillow blocks 15A and 15B on each side of the apparatus, together with the retaining plate 16 between the corresponding pillow blocks, represent a shared bracket 17 for both web guide rollers 13 and 14 that is supported in such a manner so as to swivel with regard to a machine frame, not illustrated, about a swivel point 18 provided on each of the opposing retaining plates 16. The swivel axis extending through both opposing swivel points 18 intersects the material web 11 in the plane of the web and at a right angle to its direction of travel approximately in the center of the web portion between the two web guide rollers 13 and 14.

The brackets 17, which are supported in such a way so as to swivel with respect to both sides of the material web 11, are connected with each other in the area of the retaining plate 16 by two hollow, elongated profile bodies 19 and 20 that are welded or attached in a manner similar as their front ends in such a way that two suction chambers 21 and 22 are created that can be connected to a vacuum source with a dust collector, for example, a cyclone, by at least one perforation 23 and 24 arranged in the retaining plate (16) and one dust removal pipe 25,26. In order to provide a better adaptability to the local space conditions, the dust removal pipes 25 and 26 extend approximately in a right angle or any other suitable angle to the profile bodies 19 and 20, whereby a swivel connection between the retaining plate 16 and the dust removal pipes 25 and 26 ensures a further possibility for adaptation to the local space conditions (swivel direction arrows A and B).

On the sides that face the material web 11, the profile bodies 19 and 20 are provided with lateral surfaces 19A and 20A which are constructed as perforated plates, in the example of the embodiment shown, and representing, in a general sense, planar plates provided with suction openings 27, whereby these plates extend over the entire width of the material web and a certain portion of the path of the material web 11 in the web advance direction and are arranged parallel to the material web 11. The flow arrows C indicate the direction in which the suction air and the dust particles contained therein flow inwardly through the suction openings 27 of the plates (lateral surfaces 19A, 20A).

The fact that the brackets 17 and the profile bodies 19 and 20 form a unified carrier arrangement for the web guide rollers 13 and 14 ensures that the relative position between the material web 11 and the lateral wall surfaces 19A and 20A of the profile bodies 19 and 20 is not changed, even if this carrier arrangement is swiveled about the swivel point 18.

Pressure chambers 29 and 30 that are integrated with the profile bodies 19 and 20 in the form of pipes 31,32 and that extend over the width of the machine are provided, whereby these pipes have nozzles 28 to both sides of the distance gap D between the lateral wall surfaces 19A and 20A through which the material web 11 can be supplied with a hydraulic fluid. This hydraulic fluid guides the material web as well as removes lightly adhering dust particles.

In the example shown in the FIGURE, the pipe 32 can be swiveled about its longitudinal axis, so that the direction of action of the nozzles can be optimized for this application purpose. A guide surface 33 is provided on the profile bodies 20 as a further insertion aid.

The preferred example illustrated in the FIGURES thus makes it possible that the distance between the surfaces of the dust removal system and the material web remains constant, independent of the swivel position of the web guide rollers 13 and 14. Both lateral surfaces of the web material are cleaned simultaneously. The lateral surfaces 19A and 20A in connection with the nozzles 28 simplify the automated insertion of the material web into the width adjusting machine. The profile bodies 19 and 20 serve simultaneously as a vacuum chamber and as a part of the carrier arrangement of the web guide rollers 13 and 14, so that other conventional structural elements usually utilized for this purpose can be omitted.

The suction device according to the invention can basically also be combined with other cylinders or rollers of a reel cutting machine in an advantageous manner, as will be apparent to one skilled in the art, without departing from the principles of the invention.

What is claimed is:

1. Apparatus for adjusting the relative lateral positions of a plurality of co-traveling cut webs (11), and removing particulate matter therefrom, the apparatus including at least two web guide rollers (13,14), characterized in that:

the apparatus includes a pair of opposed, parallel plates (19A,20A), each of which is provided with a plurality of openings (27) therethrough, the plates arranged with the openings adjacent a portion of the web path of travel on either side of the web, for receiving particulate matter through the openings from the surfaces of the traveling webs, and disposed intermediate the at least two web guide rollers (13,14);

the at least two web guide rollers (13,14) are arranged one behind the other in the direction of web travel (12) and are bowed convexly (13) and concavely (14), respectively, for adjusting and maintaining the lateral positions of the cut webs relative to one another;

the apparatus includes two hollow profile bodies (19,20), each hollow profile body disposed about a corresponding plate (19A,20A) on either side of the traveling webs in substantially opposed array, the two hollow profile bodies for maintaining sub-atmospheric air pressure therewithin to urge particular matter from the webs and through the plate openings into the two hollow profile bodies;

the two hollow profile bodies are structurally linked in a carrier arrangement on which the at least two web guide rollers (13,14) are mounted.

2. Apparatus for adjusting the position of a plurality of traveling webs, and removing particulate matter from the surfaces thereof, as set forth in claim 1, wherein the apparatus is characterized in that:

the two hollow profile bodies (19,20) are rigidly connected on one corresponding end thereof;

a bracket (17) is mounted to each end of both hollow profile bodies to rotatably mount the at least two web guide rollers (13,14) on both sides of the plates, whereby the two hollow profile bodies and the two brackets form the carrier arrangement.

3. Apparatus for adjusting the position of a plurality of traveling webs, and removing particulate matter from the surfaces thereof, as set forth in claim 2, wherein the apparatus is characterized in that:

the carrier arrangement includes an axis of rotation (18) which extends laterally of the apparatus in the plane of the co-traveling webs, the carrier axis arranged essentially parallel with the rotational axis of the at least two web guide rollers (13,14) arranged upstream and downstream of the plates.

4. Apparatus for adjusting the position of a plurality of traveling webs, and removing particulate matter from the surfaces thereof, as set forth in claim 3, wherein the apparatus is characterized in that:

the carrier arrangement is so constructed and arranged as to be capable of being rotated about its axis of rotation (18) with the plate (19A,20A) on each hollow profile body (19,20) and the at least two guide rollers (13,14) maintaining their positions relative to the span of the cut webs between the at least two guide rollers.

5. Apparatus for adjusting the position of a plurality of traveling webs, and removing particulate matter from the surfaces thereof, as set forth in claim 1, wherein the apparatus is characterized in that:

at least one nozzle means (28,29) is disposed within each of the two hollow profile bodies for supplying a pressurized fluid to the traveling web.

6. Apparatus for adjusting the position of a plurality of traveling webs, and removing particulate matter from the surfaces thereof, as set forth in claim 5, wherein the apparatus is characterized in that:

the nozzle means (28,29) is arranged in each of the two hollow profile bodies for spraying pressurized fluid onto each of the opposed surfaces of the traveling plurality of webs.

7. Apparatus for adjusting the position of a plurality of traveling webs, and removing particulate matter from the surfaces thereof, as set forth in claim 1, wherein the apparatus is characterized in that:

an angled dust removal pipe (25,26) is disposed in at least one of each of the hollow profile bodies for linking the hollow profile body (19,20) with a source of sub-atmospheric air pressure;

at least one nozzle means (28,29) is disposed within each hollow profile body for supplying a hydraulic fluid to the traveling web.

8. Apparatus for adjusting the relative lateral positions of a plurality of co-traveling cut webs (11), and removing particulate matter therefrom, the apparatus including at least two web guide rollers (13,14), characterized in that:

the apparatus includes at least one hollow profile body (19,20) on each side of the co-traveling cut webs in which at least one plate (19A,20A) is mounted in each of the at least one hollow profile body and which extend laterally over the width of the plurality of traveling webs, the at least one plate being provided with a plurality of openings (27) arranged therethrough, the at least one plate arranged with its openings adjacent a portion of the web path of travel intermediate the at least two web guide rollers (13,14) for exposing the particulate matter on the cut webs to sub-atmospheric air pressure within the at least one hollow profile body (19,20) for urging the particulate matter off the cut webs and into the at least one hollow profile body (19,20);

the at least two web guide rollers (13,14) are arranged one behind the other in the direction of web travel (12) for adjusting and maintaining the lateral positions of the cut webs relative to one another, and for guiding the webs substantially in a plane of travel between the at least two web guide rollers;

the at least one hollow profile body is structurally linked in a carrier arrangement on which the at least two web guide rollers (13,14) are mounted;

the carrier arrangement includes an axis of rotation (18) which extends laterally of the apparatus in the plane of the co-traveling webs, the carrier axis arranged essentially parallel with the rotational axes of the at least two web guide rollers (13,14) arranged upstream and downstream of the at least one plate;

the carrier arrangement is so constructed and arranged as to be capable of being rotated about its axis of rotation (18) with the at least one plate (19A,20A) on the at least one hollow profile body (19,20) and the at least two guide rollers (13,14) maintaining their positions relative to the span of the cut webs between the at least two guide rollers;

an angled dust removal pipe (25,26) is disposed in at least one of the at least one hollow profile body for linking the profile body (19,20) with a source of sub-atmospheric air pressure;

at least one nozzle means (28,29) is disposed within the at least one hollow profile body for supplying a hydraulic fluid to the traveling web.

* * * * *

UNITED STATES PATENT AND TRADEMARK OFFICE

CERTIFICATE OF CORRECTION

PATENT NO. : 5,533,659

DATED : 07/09/96

INVENTOR(S) : Walter G. Meyer

It is certified that error appears in the above-indentified patent and that said Letters Patent is hereby corrected as shown below:

Column 1, line 37: "ram" should read --mm--.

Column 1, line 54: A whole paragraph was omitted:

In European Patent Application No. 0 431 275 A2, apparatus is disclosed for spreading the relatively narrow, component web strips produced when a traveling, relatively wide web is slit longitudinally into a plurality of such strips. The plurality of traveling, relatively narrow, web strips are first spread by a first, bowed, rotating roll, and are then guided back into parallel, co-traveling array by being passed over a second, bowed, rotating roll. The apparatus is provided with a regulation mechanism which is fitted to correct the directional angles between the bowed rolls such that the direction angles between the bowed rolls are adjusted to the desired values. This apparatus neither collects dust from the web-slitting process, nor does it provide a means for collecting such dust operating in conjunction with the web-spreading bowed rolls.

Signed and Sealed this

Thirteenth Day of May, 1997

*Attest:*

*Attesting Officer*

BRUCE LEHMAN

*Commissioner of Patents and Trademarks*